US005141063A

United States Patent [19]

Quesenbury

[11] Patent Number: 5,141,063

[45] Date of Patent: Aug. 25, 1992

[54] RESTRICTION ENHANCEMENT DRILL

[76] Inventor: Jimmy B. Quesenbury, P.O. Box 625, Waterflow, N. Mex. 87421

[21] Appl. No.: 565,260

[22] Filed: Aug. 8, 1990

[51] Int. Cl.[5] ..... E21B 10/66

[52] U.S. Cl. ..... 175/267; 175/286

[58] Field of Search ..... 175/267, 258, 259, 265, 175/286, 382

[56] References Cited

U.S. PATENT DOCUMENTS

| | | | |
|---|---|---|---|
| 1,752,092 | 2/1930 | Kapeluchnikoff . | |
| 1,776,018 | 9/1930 | Brown . | |
| 1,817,986 | 8/1931 | Kapeluchnikoff . | |
| 1,835,108 | 12/1931 | Arthur et al. . | |
| 1,868,702 | 7/1932 | Granville . | |
| 2,049,450 | 8/1936 | Johnson . | |
| 2,177,721 | 2/1939 | Johnson et al. . | |
| 2,238,998 | 4/1941 | Grant . | |
| 2,997,119 | 8/1961 | Goodwin . | |
| 4,189,185 | 2/1980 | Kammerer, Jr. et al. | 175/267 |
| 4,401,171 | 8/1983 | Fuchs | 175/267 |
| 4,646,826 | 3/1987 | Bailey et al. | 175/286 |
| 4,915,181 | 4/1990 | Labrosse | 175/267 |

*Primary Examiner*—Terry L. Melius
*Attorney, Agent, or Firm*—Maxwell C. Freudenberg; Kenton L. Freudenberg

[57] ABSTRACT

An expandable drill bit for cleaning solidified cement from a well casing used in oil drilling operations. The bit has an initial diameter which allows it to be passed through a permanent restriction in a well casing and thereafter expanded to clean out the casing below the restriction. The bit has three uniformly spaced cutting elements which may be fully retracted within the diameter of the cylindrical outline of the body of the bit and are located at the forwardmost end in a strengthened portion of the body. The cutting elements have projections which are engaged by the forward end of a piston sliding along the axis of the drill body within a cylinder bore and are actuated thereby to their cutting positions, with their cutting edges generally radially extending but slightly forwardly divergent, by the hydraulic pressure on the piston of a fluid forced down through the drilling string which carries the bit. The piston has a central bore and a passage extending therefrom to communicate with an annular recess in the outer surface of the piston body. After the piston is forced to the position in which the cutting elements are actuated to their extended cutting positions, this recess communicates with ports in the wall of the cylinder bore which extend to passages in the tool body having outlet ports at the cutting end of the drill body. Cutting elements in their retracted positions have converging edge portions which guide the drill through restrictions during movement toward a drilling location and which are moved to parallel wall engaging positions to support the tool during drilling. The drill string is lubricated while being retracted from a well for repair or replacement of the drill bit by a device comprising a flat cylindrical annular plate inserted below the blowout preventers of a well head and comprising radial passages surrounding the drill string and forming spray nozzles for controlled pressurized insertion of a lubricating fluid sprayed around the circumference of the drill string. A plurality of spring biased check valves in the passages prevent the escape of pressure from within the well.

20 Claims, 6 Drawing Sheets

RESTRICTION ENHANCEMENT DRILL

BACKGROUND OF THE INVENTION

The present invention relates to an expandable drill bit to be used in oil drilling operations for the purpose of cleaning solidified cement from within the perforated casing of a previously drilled well which has been sealed with the cement.

A typical bore resulting from drilling for oil is fitted with a well casing or liner made of steel. At some point within the casing a permanent interior collar, known as a restriction, is fitted to restrict the inner diameter so that an additional "string" or pipelike member, through which the oil will flow, can be inserted and the flow of oil directed into the string. The restriction typically has an internal diameter approximately one-half of the diameter of the inner diameter of the casing in which it is used. The oil producing portion of the well is located below this restriction. The walls of the well casing are perforated using a perforating "gun" to allow the flow of oil into the casing from an area surrounding the casing where oil is retrievable. At times it may be necessary to seal off a perforated area to prevent intrusion of undesirable material such as water or to realign the perforated area with the oil bearing area. A common practice is to seal or "squeeze" a perforated casing by filling a portion of it completely with cement which hardens in place, eliminating perforations in undesired areas. However, after sealing in this manner, it is generally necessary to ream or clean out all or part of the cemented casing which is, by necessity, located below the restriction, and the restriction prevents such reaming with the use of a cutting or drilling bit with a fixed diameter larger than that of the restriction opening. Sealing with solid cement and then reaming out the desired portions of the well casing by using an expandable drill bit in accordance with this invention has many advantages over selectively sealing only the casing walls in the perforated area including:

(1) A higher quality can be retained in the cement by preventing the introduction of contaminants.
(2) The cost of the operation can be lower since no pilot hole is required.
(3) The full size of the internal bore of the casing remains after reaming, allowing the largest perforating guns to be used when reperforating the casing.
(4) The interior surface of the casing remains relatively smooth and consistent, eliminating the possibility of cement boulders falling in and interfering with or sticking guns during the subsequent perforating operation.

An ordinary drilling bit, which usually has three rotating cones, provides the greatest drilling speed, but will not pass through a restriction and therefore cannot be used to clean a casing to its full inner diameter. Prior art devices known as "underreamers" have previously been used to accomplish the task of cleaning out a casing. A typical underreamer consists of a flat faced pilot bit or guide mounted to a cylindrical head no larger in diameter than the restriction through which it must pass. Recessed into the side of the cylinder are two pivotably mounted cutting heads with cutting surfaces capable of pivoting outward to an expanded diameter to cut a bore diameter equal to the size of the casing. Because these cutters must be retracted into the cylindrical cutting head when not in use, the cross sectional area of the cutting head is necessarily decreased by any increase in size or number of the cutters. Because of this decrease in cross sectional area, the head is necessarily weakened, and so is generally limited to two cutters. Also, where the cutters must be retracted into recesses within the sides of the cylindrical body, any bending or deformation of these cutting surfaces may prevent retraction of the cutters into the cylinder body. An inability to retract the cutters may, in turn, prevent the tool from passing through a restriction to remove it from a well and may require abandonment of the tool string and/or the well itself. Because of the significant expense of well drilling and the cost of equipment involved, it is obviously desirable to minimize the possibility of any problem which may result in abandonment of the well or any equipment. Also, the flat face of the typical pilot bit or guide does not readily provide a guide for the tool when either (1) inserting the tool into a well and through square shouldered restrictions, or (2) cleaning hardened cement from a well.

SUMMARY OF THE INVENTION

The present invention, in contrast, provides a tool with an expandable diameter which positions the cutting elements and surfaces at the forward end of the tool to (1) eliminate the need for a pilot bit, (2) eliminate the need for a weakened drill body and (3) allow the use of at least three cutters to provide far greater stability of the drill head, i.e less likelihood of "bouncing" of the rotating tool where the drilling is not being done in a vertical hole. When a tool is operated in a horizontal well downward gravitational forces are generally perpendicular to the direction of drilling. A drilling tool has a tendency to rest on or be pulled toward the lower surface of the well. Ideally, the tool would be provided with a supporting means directly below its centerline to counteract the force of gravity. When a tool with only two cutters is used, the cutters are, at times, oriented horizontally opposite one another, with each being located 90 degrees from this ideal supporting point. In contrast, a tool using 3 cutters always has at least one cutter positioned 60 degrees or less from the desirable supporting point. Because the three cutters of the present invention provide or define an essentially conical leading surface of the tool when in their closed position, the tool is more readily passed through the well casing in general and through restrictions in particular than a tool having a fixed, relatively flat pilot drill as a leading surface. Also, in their extended drilling positions the cutting elements of the present invention extend outwardly and forwardly, i.e. forwardly divergent, at an angle of 15 degrees with respect to a transverse plane perpendicular to the longitudinal axis of the drill. The cutting surface formed by these elements is thus concave and the cone defined by these cutters, in combination with the cutting buttons imbedded at the center of this concave area in a transverse plane at the forward end of the body, tends to keep the drill more centrally located in the drilled passage. With flat or forwardly convergent drilling surfaces the drill engages the casing walls with greater forces which not only causes greater wear of the drill but also can cause the motor to stall.

Many parameters affect the optimum drilling rate. The drill bit is mounted on the forward end of a "downhole" motor carried by a drill string coil and the axial load on the cutters during drilling is normally limited to a total force of from 500 to 1500 pounds by controlling the advance of the drill string coil in manners well known. The cutter rotating speed may be selected depending on the various well and operating characteristic parameters and may be in a range of from 300 to 700 revolutions per minute (rpm).

The cutters of the present invention are moved to their "open" cutting position by a piston sliding within the drilling head of the bit, and actuated by an initially higher hydraulic pressure of a fluid which is forced through the drilling string to operate a rotating hydraulic "downhole" motor, and on through the drilling head itself. During drilling the drilling fluid for operating the motor is supplied at a pressure lower than the initial cutter actuating pressure and serves as a drilling lubricant and means for removal of the loose material generated by the drilling process. After passing through the motor and drilling head the fluid flows back out of the hole being drilled carrying with it the loose material from the drilling process. When drilling fluid is not being passed through the drilling string, the cutting elements are in the fully retracted position and the internal passages within the drilling head through which the drilling fluid would pass are blocked. This prevents the undesirable intrusion of debris or contaminants from the well into the drilling head, motor or drill string.

In order to position the tool in a well to clean out cement, the drill is kept in a closed position in which the cutters are retracted and folded together to form a generally pointed end which is easily guided through a well casing and readily passes through any square shouldered restrictions therein. The well casing liners in which this drilling device may be used are generally in the range of approximately 3½ to 9⅝ inches outside diameter with inside diameters ranging from about 2.9 to 8.5 inches. A "restriction" through which the drilling device must pass before being actuated for its drilling function may typically be from 40 to 300 feet in length.

It is an object of the present invention to provide an expandable tool for clearing cement from within a well casing and which can be readily passed through restrictions smaller than the well casing to be cleared.

It is another object of the invention to provide a drilling tool in which expandable cutting elements form the forwardmost portion of the tool in its cutting configuration.

It is still another object of the present invention to provide an expandable drilling tool with more than two radially oriented and uniformly circumferentially spaced cutting elements.

It is another object of the invention to provide a tool for cleaning out cemented well casings in which the tool is expandable from a closed position with a generally pointed or forwardly convergent leading and guiding edges to an expanded position with forwardly divergent leading and cutting edges defining a generally conical concave cutting surface.

Another object of the invention is to provide improved means for lubricating the drill string coil as it withdrawn from the well casing when the drill bit is being pulled back by the coil for retrieval or repair.

DESCRIPTION OF THE PREFERRED EMBODIMENT

Figure 6:
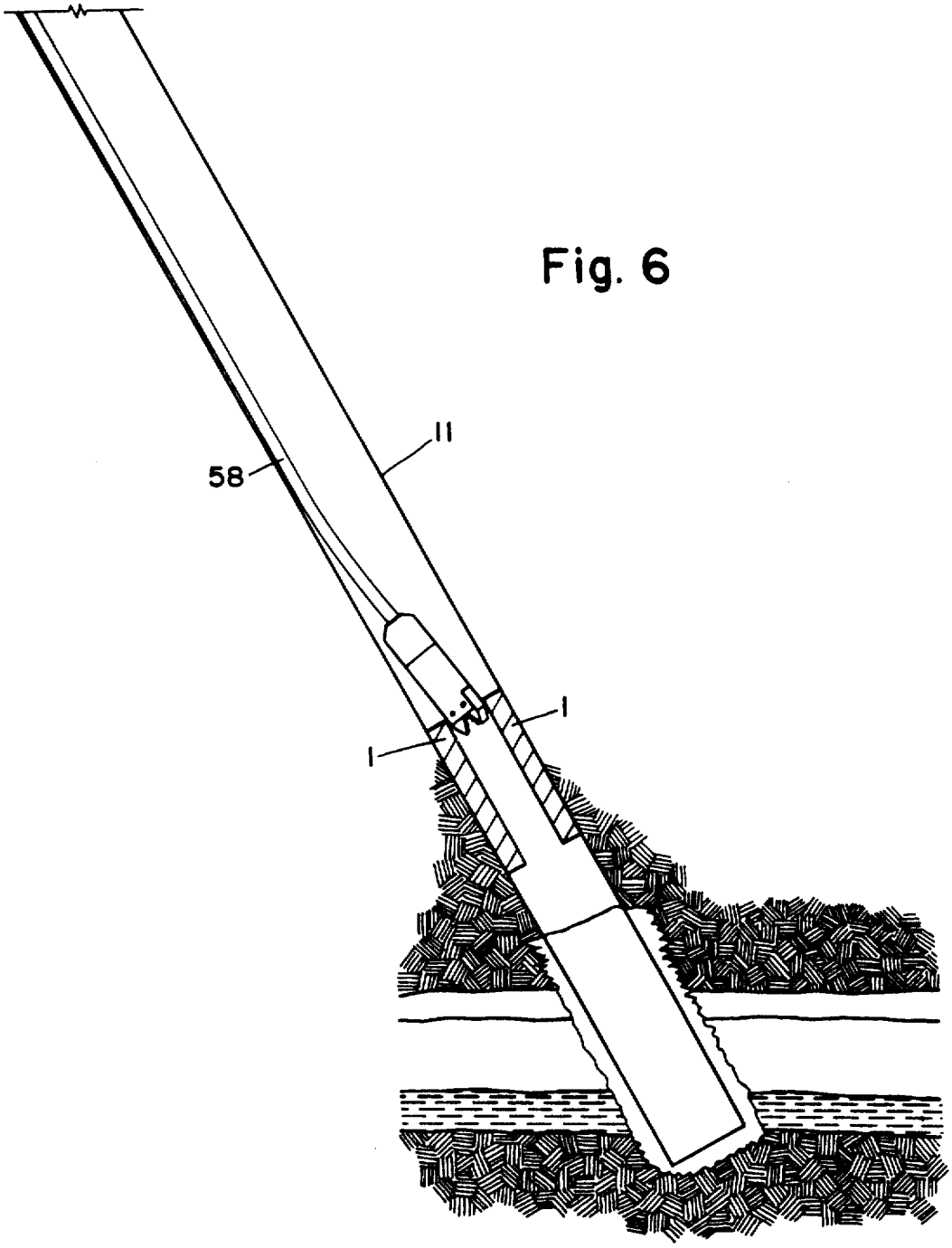
FIG. 6 is a cross-sectional representative view of a typical well in which the tool of the preferred embodiment would be used.

The present invention is a rotary cutting tool or bit designed to run below a hydraulically or pneumatically operated "downhole" motor or with a completely rotating work string. The tool comprises a generally cylindrical body 1 with an outside cylindrical surface having a diameter sufficiently small to fit through collars or restrictions 2 within a well casing as shown in FIG. 6. An upper or rear portion is provided with a common threaded fitting 20 with "acme" threads, as used for drilling tools, which allows the tool to be affixed to an adapter 31 which is, in turn, affixed to whatever motive means is being used.

Figure 2:
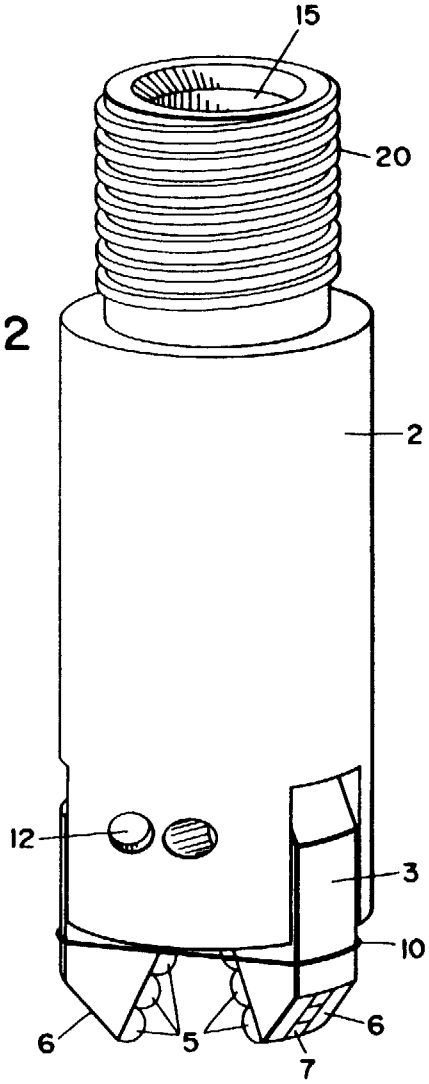
FIG. 2 is a perspective view of the tool of the preferred embodiment showing the cutters in the closed position.
Figure 1:
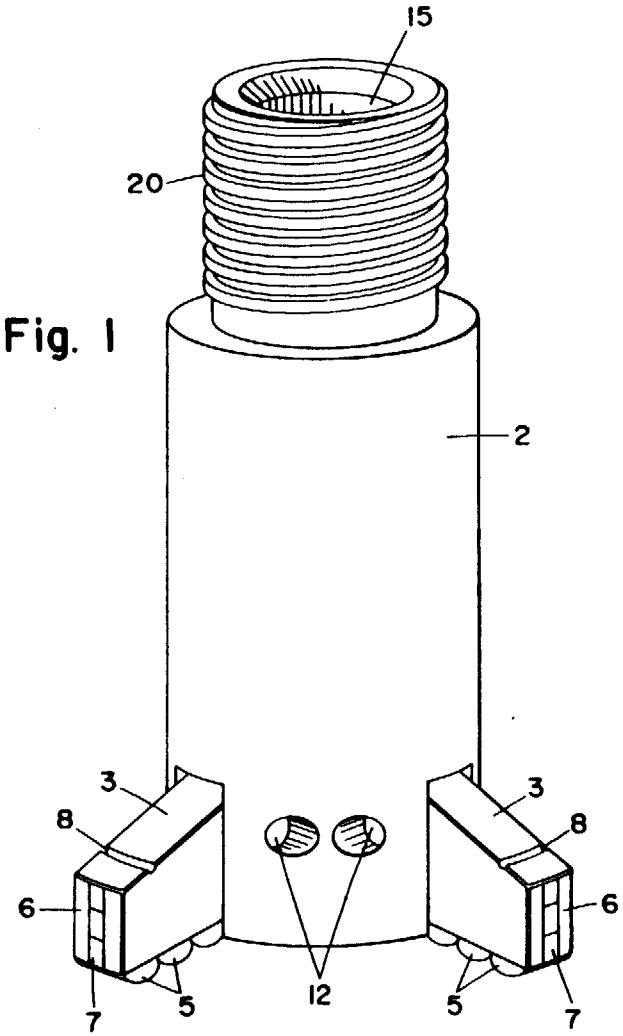
FIG. 1 is a perspective view of the tool of the preferred embodiment showing the cutters extended to the open position.

The tool is provided at its lower end with three pivotable cutting elements 3, at equally spaced positions around the circumference of the main body. The cutting elements 3 are movable between the open position shown in FIGS. 1, 4 and 5, and the closed position shown in FIGS. 2 and 3, pivoting through an arc of approximately 55 degrees in moving between the two positions. Each cutting element has a cutting edge 4 and a guiding edge 6 oriented at an angle of about 75 degrees relative to one another. The cutting and guiding edges are provided with "buttons" 5 and 7, respectively, of tungsten carbide or other material which is highly resistant to abrasive wear, which are brazed or otherwise securely affixed in place. On the cutting edge 4 the buttons 5 provide a durable surface to provide the necessary abrasive cutting action. On the guiding edges 6 the buttons 7 are recessed and ground flush with exterior surface to serve as gauging elements which provide generally parallel axially extending wear-resistant surfaces which are sufficiently abrasion resistant to maintain a relatively constant diameter for the tool when it is operated with the cutters in the extended position. With the cutters in the closed position, and fully retracted within the imaginary cylinder defined by the outer cylindrical surface of the bit body, the guiding edges also form the leading extremity of the tool, and, during rotation of the device, define a generally conical or frustum-shaped or forwardly convergent surface with an exterior wall at an angle of approximately 55 degrees to the axis of the tool and its direction of travel during use. The flat leading or forwardmost area defined by the frustum shaped surface is a circular "nose" which has a diameter approximately 35 percent of the diameter of the larger circular base of the frustum and the main tool body. When the tool is in the expanded or open position, the guiding edges formed by the gauging buttons are parallel to the axis of the tool. The concave frustum shape of the rotating generally radially extending leading cutting edges of the tool allows the tool to make a corresponding convex frustum or conical shaped cut which serves as a seat to guide the rotating tool, keeping it centered without having to follow any pilot bore.

Each cutting element pivots upon a replaceable supporting pin 12 passing transversely through a portion of the cylindrical body and held in place by removable set screws 13 which are installed and accessible through openings in the lower end of the main tool body. By providing for simple replacement, these parts may be replaced when worn and the main body reused. A portion of each cutter is directly overlapped and abutted on either side by portions 9 of the drill body so that the cutting elements are not dependent entirely upon the pin 12 for support.

The outer edge of each cutting element in the closed position is provided with a groove or recess 8 to receive an expendable elastic band or O-ring 10 which passes around the three cutting elements to keep them in the closed position as the tool is inserted into a well and which breaks upon the application of the hydraulic pressure to the tool allowing the cutters to be forced to their open position.

After the drill has passed through the restriction in the casing or production string and is located immediately above the area from which cement is to be cleared, drilling fluid such as sea water is pumped to a cylindrical internal expansion chamber 15 of the tool via the work string. The resulting hydraulic pressure actuates the piston 17 to slide axially within the cylindrical piston bore 15 to the drilling position shown in FIG. 4. As the initial fluid pressure increases the size of the expansion chamber formed by members comprising the piston and the bit body the lower end 18 of the piston engages lugs 19 on the cutting elements 3 causing them to pivot to their expanded position, and breaking the disposable elastic retainer band. Prior to use of the tool, the upper or rear end 21 of the piston is fitted with a removable flow control nozzle structure threaded into and seated in place to allow predetermination of the flow rates and pressures of the drilling fluid during use of the tool with the piston 17 in the drilling position. The flow control nozzle structure comprises a threaded member 23 having a central passage formed by a tungsten carbide insert 22 suitably bonded to the threaded member and having an internal diameter selected to provide a flow rate of fluid to the drive motor which will provide maximum motor speed at the maximum surface operating pressure at the well head. Inserts with different nozzle sizes may be inserted into like threaded members to facilitate changing nozzle size in the same piston by replacement of the nozzle structure. The flow control nozzle is flush with or recessed slightly below the rear face of the piston 17 so that the maximum rearward movement of the piston in its initial preactuated position is determined by its abutment with the shoulder 32 of a hollow adapter 31 which has at one end internal square acme threads for threaded engagement with the threaded fitting 20 on the rear or upper end of the drill body. This hollow adapter has an inner diameter of smaller diameter than the bore of the tool body to limit rearward movement of the piston. The other end of the adapter has a conventional external male threads for engagement with the drive motor.

The piston 17 is provided with a hollow bore 25 which communicates with an annular recess 26 in the outer surface of the piston body. This recess communicates with port 28 and another not shown in the side of the cylinder bore when the piston has moved to its operating position. From each of these ports, a passage 29 in the tool body extends to an outlet port 30 for the escape of pressurized drilling fluid to the area of the cutting elements at the end of the drill body. Each port 30 is located within a row of tungsten carbide buttons 33 embedded in the forwardly facing end of the cylindrical body to provide cutting surfaces located centrally with respect to the cutting areas of the rotating cutting elements. These rows extend generally radially at angles which bisect the 120 degree angles between the planes of the cutting elements. The outlet ports 30 are located at varying radii from the axis of the cylindrical body to aid in distributing drilling fluid over the end of the drill body. The cutting buttons 5 on the cutting edges of the cutting elements and the cutting buttons 33 forming the cutting surfaces on the end of the cylindrical body are located so as to insure that each portion of the cutting area defined by rotation of the outer tips of the cutting edges of the cutting elements of the rotating tool is covered by a portion of the rows of tungsten carbide cutting buttons 5 or 33 at some point of the tool rotation.

Figure 3:
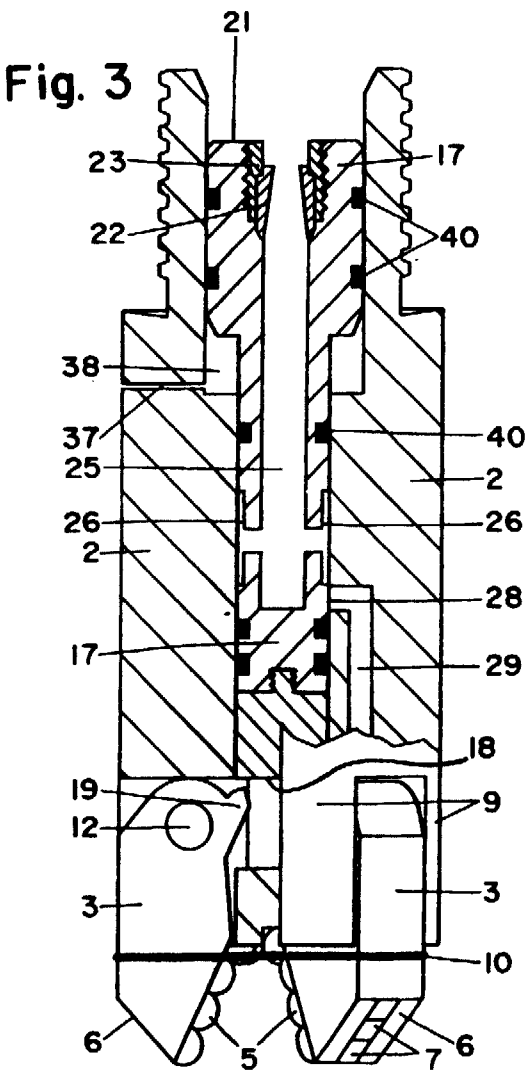
FIG. 3 is a partial cross sectional view of the tool of the preferred embodiment showing the cutters in the closed position.

In the initial retracted position of the piston as shown most clearly in FIG. 3, its lower or abutment end face 18 is spaced a small distance from the lugs 19 of the cutting elements. This allows a pressure test of the drill and its string while the drill with a 3.5 inch diameter body is located in a "lubricator" 40 having an inside diameter of 4 1/16 inches. The testing is conducted by opening a valve to internally pressurize the drill string and the drill at a pressure greater than its normal operating pressure for drilling, 4000 pounds per square inch (psi) for example, but restricting the volume of flow. The volume of flow is just sufficient to ensure operation of the drive motor but not sufficient to create the high forces on and displacement of the piston which would normally be used to fully expand the cutting elements for a drilling operation. This restricted flow for motor testing can pass from the motor, through the piston and escape through a small opening between the encircling passage 26 of the piston and the passage 28 in the cylinder wall, this small opening corresponding to the amount of lost motion occurring in movement of the piston before it contacts the lugs. The flow rate for testing may be, for example, 8 gallons per minute, which is very low relative to the flow rate of 1.7 barrels (equal to 71.4 gallons) per minute used for drilling.

At the lower end of the piston 18, which contacts the lugs of the cutting elements, the piston is provided with a replaceable solid cap 35 with male threads 36 threaded into a corresponding cavity with female threads concentric with the axis of the piston. In use, the contact points between the piston end and lugs of the cutting heads are subject to significant abrasive wear. By providing a replaceable end cap on the piston this wear can be accommodated by simple replacement of only the piston cap rather than replacing or machining the entire piston. This cap is made with an axial length approximately equal to or greater than its diameter so that it is at least partially contained within and supported by the sides of the lower end of the cylindrical bore 15 in order to limit the stress, especially shear forces, which must be borne by threads 36 which hold the cap in place and also to minimize the likelihood of the cap becoming twisted or misaligned and jammed within the bore if the mating threaded portions should become broken. This helps insure that the cutting elements can always be retracted.

A relief port 37 is provided in the body of the drill to prevent a buildup of pressure within cavity 38 as the piston is moved to force the cutters to their expanded position. The piston is provided with annular channels 39 at several points into which rubber or elastic O-rings 40 are installed to surround the piston and seal it within the cylinder.

Figure 4:
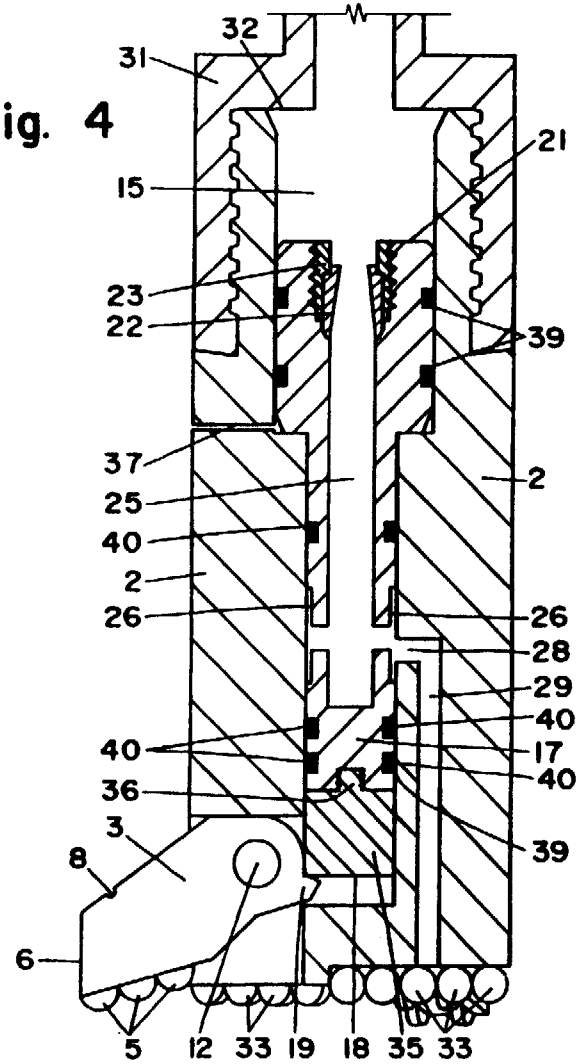
FIG. 4 is a cross sectional view of the tool of the preferred embodiment showing the cutters extended to the open position.
Figure 5:
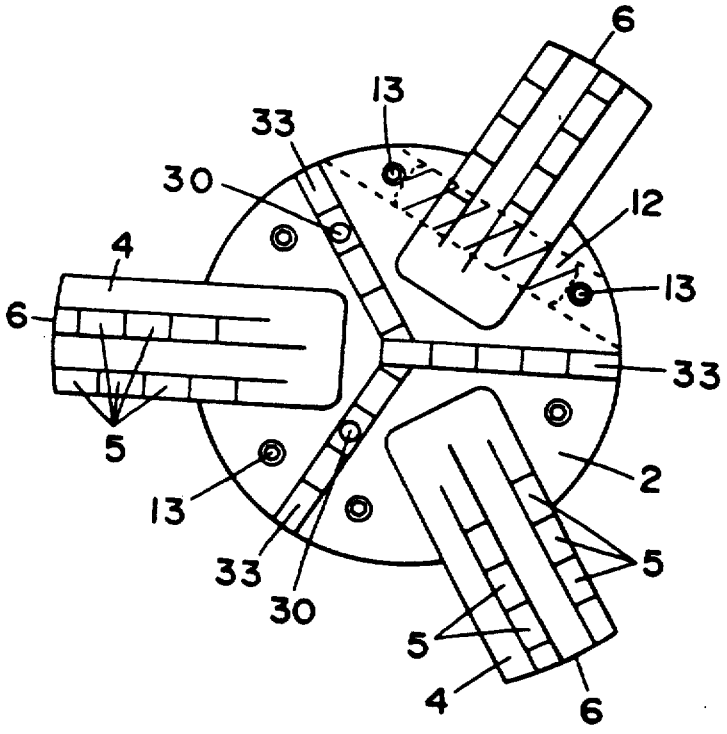
FIG. 5 is a view of the cutting end of the tool of the preferred embodiment showing the cutters extended to the open position.

As shown in FIG. 4 the cutters have a relatively straight surface 6 to bear against the wall of the casing being cleaned when the cutters are in the open expanded position. The lower end of the cylindrical body is provided with three additional rows of tungsten carbide buttons 33 which are exposed as a portion of the leading surface of the tool in its expanded position and which, in conjunction with the buttons located on the cutting edges of the cutting elements, provide a concave facial cutting surface over the full diameter of the tool in its expanded position.

In order for the cutter to be extracted from a hole, the pumping of fluid is ceased to remove all hydraulic pressure. The cutters will then freely pivot to their closed position as the assembly is pulled from the hole.

In the preferred embodiment all parts of the drilling device except the tungsten carbide gauge and cutting buttons at the forward end and the end abutment on the piston which actuates the cutting elements are made of 4140 grade steel. The end abutment on the piston is made of 4130 grade steel which is softer than 4140 grade. This provides for most of the wear at the interengaging surfaces between the cutting element lugs and the piston abutment to occur at the latter and facilitates reconditioning the drilling device by replacing the piston abutment without having to replace the cutting elements as frequently.

For use in unusually corrosive passages where there is a concentration of a corrosive fluid or gas, such as hydrogen sulfide, the parts made of 4140 grade steel may be made of stainless steel having the necessary strength.

The lubricator 40 is a tubular structure located above a conventional blowout preventer structure 42 with a conventional injector head 43 atop the lubricator. Stripper rubbers 44 tightly encircle the wall of the drill string coil tubing where the string enters the injector head with the motor and drill structures hanging therebeneath in the lubricator for testing.

During withdrawal of the string after a drilling operation, the external surface of the string coil tubing is lubricated by a lubricating collar 46 located just below the blowout preventer. Although the string may have been lubricated prior to entry into the well casing, this lubricant gets removed by abrasive action on the string exterior as it moves within the casing and as it is washed by the fluids passing over its exterior during drilling.

Figure 7:
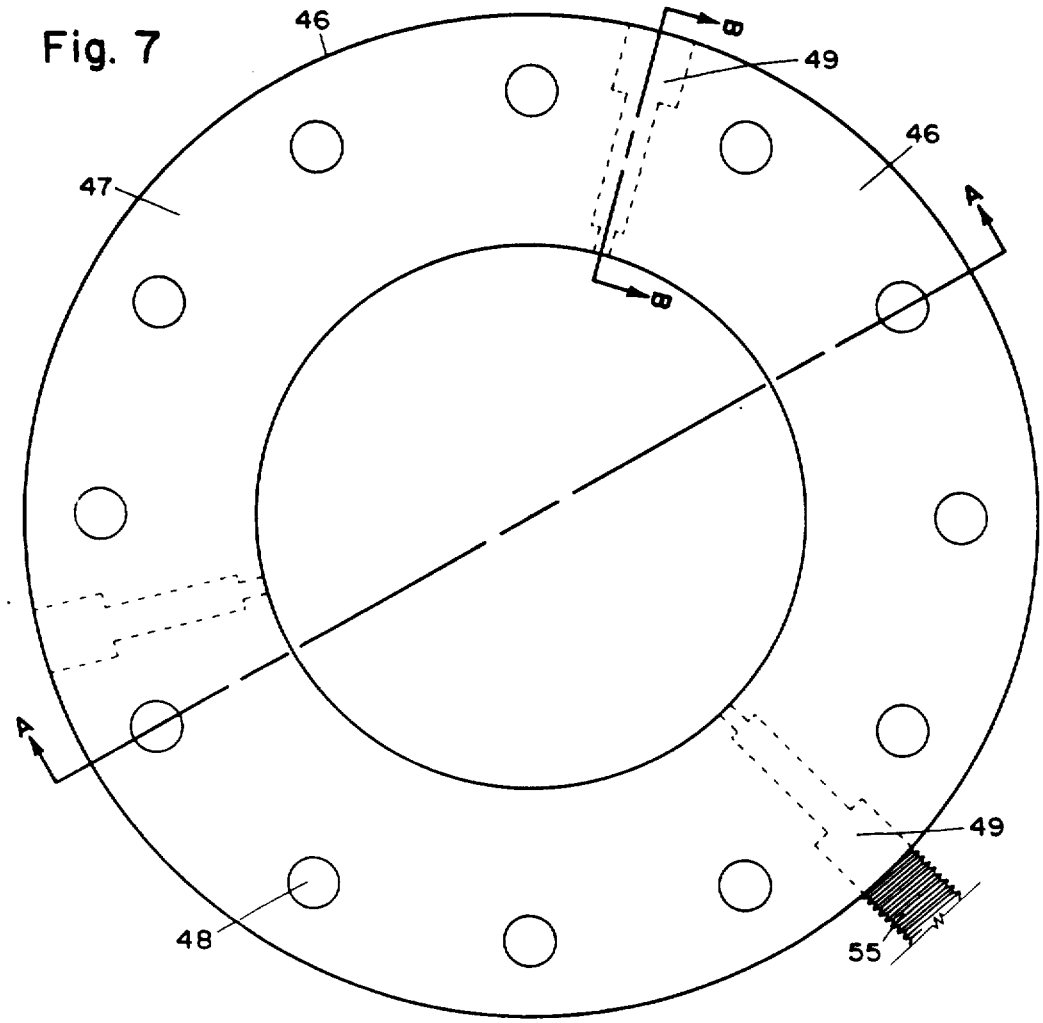
FIG. 7 is a plan view showing detail of the lubricating collar of the present invention.
Figure 8:
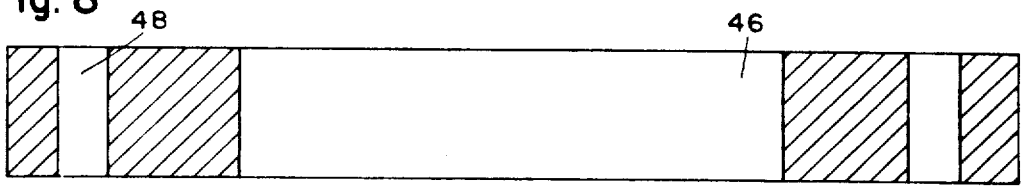
FIG. 8 is a cross-section of the lubricating collar taken at A—A of FIG. 7.
Figure 9:
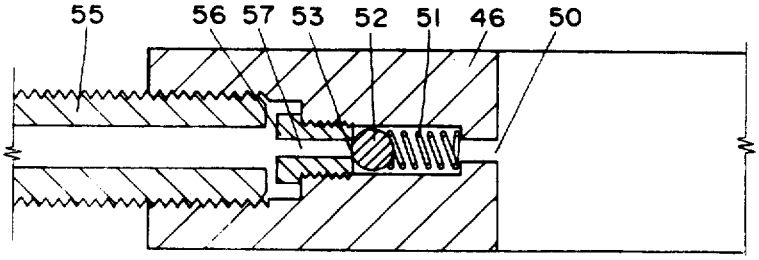
FIG. 9 is a cross-section of the lubricating collar taken at B—B of FIG. 7, and showing detail of the injector assembly.
Figure 10:
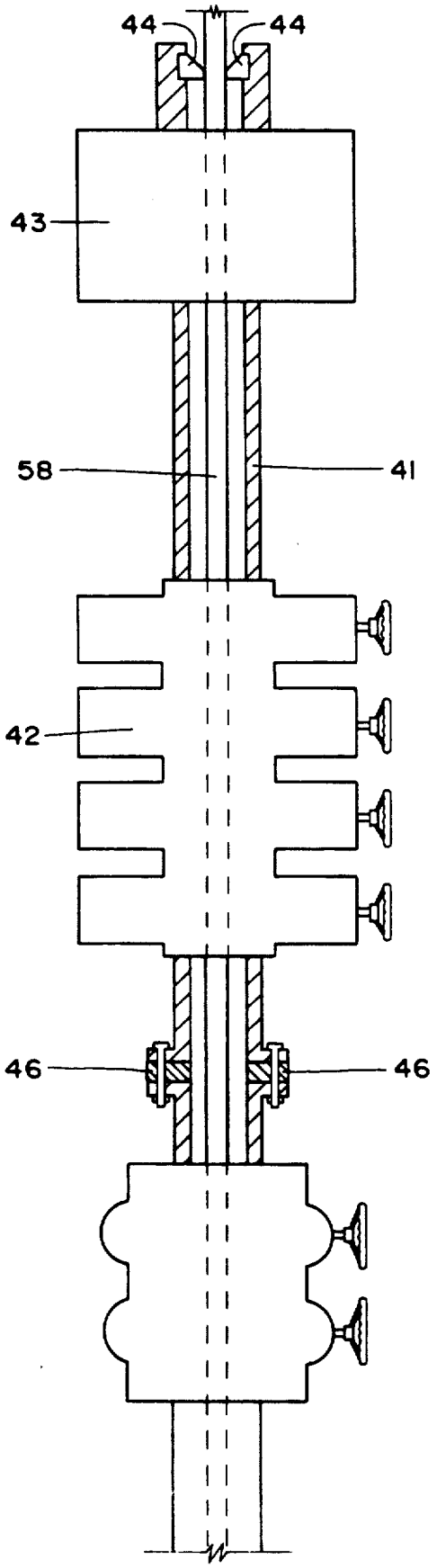
FIG. 10 is a cross-sectional view of a typical wellhead showing the lubricating collar of the present invention in place.

Referring to FIGS. 7–9, the lubricating collar 46 is a flange-like circular annular plate 47 having a plurality of uniformly spaced axially extending bolt holes 48 for securing it in the series of components of the well head structure in a position where the drill string will pass centrally therethrough. The collar has three or more uniformly spaced radially extending passages 49 therethrough for injecting or spraying a mist of lubricating fluid onto the surface of the string.

Each passage 49 has an open nozzle end 50 of ⅛ inch diameter at the inner cylindrical face of the collar from which the spray issues. In a slightly larger diameter portion of the passage is a spring biased check valve assembly having a small spring biased ball 52 seated against the inner end 53 of a valve seat 56 threaded into an intermediate portion of the collar passage. Threaded into an outer still larger diameter portion of the collar passage is a stainless steel valve body 55 with a suitable manually operable flow control means to adjust the rate of admission of lubricating fluid to the passage. The flow rate through the injectors of the lubricating collar 46 is dependent on the rate of retraction of the string coil and may be as low as 3 gallons per hour. Coil retraction rate may vary widely from, for example, 7 to 150 feet per minute.

The control valves for the several spray passages are supplied by a common source of pressurized lubricating fluid for which further conventional controls may be provided for starting and stopping the flow and for controlling the pressure. The lubricant must be supplied at a pressure substantially exceeding the well head pressure to assure that the lubricating fluid will pass through the check valves and spray upon the string. A supply pressure of 10,000 psi is suitable for a well head pressure of 4,200 psi, for example. The lubricant may be diesel oil, hydraulic fluid, aviation hydraulic fluid or a lighter weight oil which will not freeze or gel at temperatures at the well head which in Arctic oil fields may be as low as −80 to −90 degrees F.

All of the components of the well head structure may have a common internal diameter which may correspond to or be smaller than the internal diameter of the well casing tubing which is, for example, 7 inches, provided that the diameter is sufficient to permit passage of the retracted bit, motor and coil and to enable the coil to be spray lubricated as it passes through the lubricating collar.

The drilling device of the present invention may be used for drilling as described using either a gaseous fluid or a liquid fluid and appropriate motors driven by such fluids as is well known in the well drilling art.

Other variations within the scope of this invention will be apparent from the described embodiment and it is intended that the present descriptions be illustrative of the inventive features encompassed by the appended claims.

What is claimed is:

1. A drilling device for enlarging or enhancing a tubular passage comprising:

means for attaching a drive means to a rearward first end of said device for rotating said device within said passage about a longitudinal axis of the device, cutting means at the forward other end of the device including cutting surfaces for cleaning out said passage, said cutting means including a first member having three cutting elements pivotably mounted thereon with each cutting element being pivotably movable between a retracted position and a cutting position, a second member relatively slidable with respect to the first member, said second member including means engageable with each of said cutting elements and movable from a retracted to an actuating position for moving said elements from their retracted positions to their cutting positions, each member forming part of an expansible chamber, means for connecting a source of pressurized fluid to said chamber to move said second member from its retracted position to its actuating position, said device having a generally cylindrical outer surface with said cutting elements in their retracted positions being located at the forwardmost end of the device and essentially totally within an imaginary cylinder coaxial with and of the same radius as said cylindrical surface, said cutting elements in their retracted positions extending forwardly of all other portions of the device and having rearwardly diverging surfaces forming a nose structure to guide the device through a restriction in the walls of said passage, said cutting elements in their cutting positions having laterally facing bearing surfaces generally parallel to the wall of the passage being reamed and forwardly facing cutting surfaces, said bearing surfaces being located in their cutting positions at a fixed radial distance from the longitudinal axis of the device, this distance being substantially greater than the radius of said cylindrical outer surface of the device, said cutting surfaces in their cutting position providing a forwardly facing cutting area having a radius equal to said fixed radial distance.

2. A device according to claim 1 further including fluid passage means within said device having valve means controlled by relative movement of said members to allow escape of said pressurized fluid from said chamber through said device to the area of said cutting elements when said elements are in their cutting positions.

3. A device according to claim 2 wherein said second member can move with lost motion with respect to said first member before said cutting elements are initially actuated by said second member, said valve means being partially opened during said lost motion to permit testing of a drive motor for the drilling device at a reduced flow rate without actuating said second member with forces or displacement used for full displacement of the cutting members to their cutting positions.

4. A device according to claim 2 wherein said second member is a piston slidable within said first member.

5. A device according to claim 4 wherein said piston has a central passage therein communicating with said valve means, a fluid control nozzle within said central passage having an orifice therein selected to allow a desired fluid flow rate from the fluid drive motor.

6. A device according to claim 4 wherein each cutting element has a lug projecting therefrom and engageable by a forward end of the piston to actuate the cutting elements to their cutting positions.

7. A device according to claim 6 wherein said piston has a forward end face engaging said lugs for actuating the cutting elements.

8. A device according to claim 7 wherein said forward end face of the piston is a replaceable part of the piston.

9. A drilling device for enlarging or enhancing a tubular passage comprising:

a pair of members relatively slidable with respect to each other and with each member forming part of an expansible chamber, means for connecting a source of pressurized fluid to said chamber, means for attaching one end of said device to a drive means for rotating said device within said passage about a longitudinal axis of the device, one of said members having three cutting elements pivotably mounted thereon with each cutting element being pivotably movable between a retracted position and a cutting position, means on the other of said members engageable with each of said cutting elements for moving said elements from their retracted positions to their cutting positions in response to the supply of pressurized fluid to said chamber, fluid passage means within said device having valve means controlled by relative movement of said members to allow escape of said pressurized fluid from said chamber through said device to the area of said cutting elements when said elements are in their cutting positions, said device having a generally cylindrical outer surface with said cutting elements in their retracted positions being located at the foremost end of the device and essentially totally within an imaginary cylinder coaxial with and of the same radius as said cylindrical surface, said cutting elements in their retracted positions extending forwardly of all other portions of the device and having rearwardly diverging surfaces to guide the device through restrictions in the walls of said passage, said cutting elements in their cutting positions having forwardly facing cutting surfaces and laterally facing bearing surfaces generally parallel to the wall of the passage being reamed, said hearing surfaces being of a fixed radial distance from the longitudinal axis of the device, this distance being substantially greater than the radius of said cylindrical surface.

10. A drilling device for enlarging or enhancing a well casing and comprising:

an elongated body having a first end with means for attaching it to a drive means for rotating said body about a longitudinal axis, the other end of said elongated body having three cutting elements pivotably mounted thereon with each cutting element being pivotably movable between a retracted position and a cutting position, said body having an inner bore with means for connecting said bore to an external source of pressurized liquid, a piston assembly slidable within said bore between a retracted position and an actuating position in response to the supply of pressurized liquid to the bore, each cutting element having means for interconnecting it for actuation to its cutting position in response to movement of said piston from a retracted position to said actuating position, liquid passage means within said body having valve means controlled by movement of said piston to allow escape of said pressurized liquid through said body to the area of said cutting elements when said piston is in its actuating position, said device having a generally cylindrical outer surface with said cutting elements in their retracted positions being located at the foremost end of the device and essentially totally within an imaginary cylinder coaxial with and of the same radius as said cylindrical surface, said cutting elements in their retracted positions extending forwardly of all other portions of the device and having rearwardly diverging surfaces to guide the device through restrictions in the walls of said casing, said cutting elements in their cutting positions having forwardly facing cutting surfaces and laterally facing bearing surfaces generally parallel to the wall of the casing being reamed for supporting the device relative to the walls of the casing, said bearing surfaces being of a fixed radial distance from the longitudinal axis of the device, this distance being substantially greater than the radius of said cylindrical surface.

11. A drilling device for enlarging or enhancing a well casing and comprising:

a cylindrical body having a first end with means for attaching it to a drive means for rotating said body, the other end of said cylindrical body having three cutting elements pivotably mounted thereon with each cutting element being pivotably movable between a retracted position and a cutting position, each cutting element having a cutting edge and a guiding edge, said body having an inner bore with means for connecting said bore to an external source of pressurized liquid, a piston assembly slidable within said bore between a retracted position and an actuating position in response to the supply of pressurized liquid to the bore, each cutting element having means for interconnecting it for actuation to its cutting position in response to movement of said piston from a retracted position to said actuating position, liquid passage means within said body having valve means controlled by movement of said piston to allow escape of said pressurized liquid through said body to the area of said cutting elements when said piston is in its actuating position, said device having a generally cylindrical outer surface with said cutting elements in their retracted positions being located at the foremost end of the device and essentially totally within an imaginary cylinder coaxial with and of the same radius as said cylindrical surface, said cutting elements in their retracted positions extending forwardly of all other portions of the device and having rearwardly diverging surfaces to guide the device through restrictions in the walls of said casing, said cutting elements in their cutting positions having forwardly facing cutting surfaces and laterally facing bearing surfaces generally parallel to the wall of the casing being reamed for supporting the device relative to the walls of the casing, said bearing surfaces being of a fixed radial distance from the longitudinal axis of the device, this distance being substantially greater than the radius of said cylindrical surface.

12. A drilling device for enlarging or enhancing a well casing and comprising:

a cylindrical body having a first threaded end with means for attaching it to a drive means for rotating said body about a longitudinal axis of the device, the other end of said cylindrical body having three cutting elements pivotably mounted thereon with each cutting element being pivotably movable between a retracted position and a cutting position, each cutting element having a cutting edge, said body having an inner bore coaxial with and open at said threaded end of connecting said bore to an external source or pressurized liquid, an elongated piston assembly slidable within said bore between a retracted position and an actuating position in response to the supply of pressurized liquid to the bore, each cutting element having the lug thereon engageable by said piston for actuation of said element to its cutting position in response to movement of said piston from a retracted position to said actuating position, said body having a generally cylindrical outer surface with said cutting elements in their retracted being located at the forward end of the device and essentially totally within an imaginary cylinder coaxial with and of the same radius as said cylindrical surface, said cutting edges, in the cutting positions of said elements, extending radially beyond said imaginary cylinder and facing forwardly to provide a cutting area during rotation of the drilling device which has an outer cutting radius greater than the radius of said cylindrical surface, said device including guiding means having forwardly facing guiding surfaces within said imaginary cylinder and extending at the forwardmost part of the device when the cutting elements are in their retracted positions to guide the device through restricted portions of a well casing during movement of the device to a location where the cutting elements are to be extended and used, said guiding surfaces extending forwardly of at least part of the cutting edges of the cutting elements, means for shifting the position of said guiding means in response to movement of said piston from a retracted position to said actuating position whereby said cutting edges can cut in the forward direction of the device and at said cutting diameter greater than the diameter of said cylindrical outer surface, liquid passage means within said piston extending coaxially within said piston from the end of the piston nearest said threaded end to a location along said piston where it communicates with an annular channel at the outer side wall of the piston, said channel cooperating with a liquid passage means in said body having an opening at the inner wall of said bore to define valve means controlled by movement of said piston to allow escape of said pressurized liquid through the liquid passage means in said body to the area of said cutting elements when said piston is in its actuating position.

13. A drilling device according to claim 12 wherein each cutting element includes a guiding edge extending rearwardly divergently with respect to the axis of the device and cooperating with the corresponding guiding edges on the other cutting elements when all of the cutting elements are in their retracted positions to guide the device through restrictions in a well casing.

14. A drilling device according to claim 13 wherein said divergent guiding edges each form an acute angle with said axis.

15. A drilling device according to claim 12 wherein each cutting element includes a guiding edge extending parallel with respect to the axis of the device and cooperating with the corresponding guiding edges on the other cutting elements when all of the cutting elements are in their cutting positions to closely fit the inner wall of a well casing being reamed and guide the device through the well casing during cutting.

16. A drilling device according to claim 15 wherein each of said parallel guiding edges has hardened gauge buttons for engaging the inner well casing wall during cutting.

17. A drilling device according to claim 12 wherein said other end of the cylindrical body includes additional cutting surfaces so located that each portion of a cutting area defined by rotation of the outer ends of the cutting edges of the tool is covered by part of said cutting surfaces or said cutting edges at some point of the tool rotation.

18. A drilling device for enlarging or enhancing a well casing and comprising:

a cylindrical body having a first threaded end with means for attaching it to a drive means for rotating said body about a longitudinal axis of the device, the other end of said cylindrical body facing forwardly and having three cutting elements pivotably mounted thereon with each cutting element being pivotably movable between a retracted position and a cutting position, each cutting element having a cutting edge, said body having an inner bore coaxial with and open at said threaded end for connecting said bore to an external source of pressurized liquid, an elongated piston assembly slidable within said bore between a retracted position and an actuating position in response to the supply of pressurized liquid to the bore, each cutting element having a lug thereon engageable by said piston for actuation of said element to its cutting position in response to movement of said piston from a retracted position to said actuating position.

said device having a generally cylindrical outer surface with said cutting elements in their retracted positions being located at the forward end of the device and essentially totally within an imaginary cylinder coaxial with and of the same radius as said cylindrical surface, said cutting edges, in the cutting positions of said elements, extending radially beyond said imaginary cylinder and facing forwardly to provide a cutting area during rotation of the drilling device which has an outer cutting radius greater than the radius of said cylindrical surface, said device including guiding means having a retracted position within said imaginary cylinder when the cutting elements are in their retracted positions, means for shifting the position of said guiding means in response to movement of said piston from a retracted position to said actuating position whereby said guiding means forms laterally facing bearing surfaces generally parallel to and for engagement with the wall of the passage being reamed, said bearing surfaces being located, when said cutting edges are in their cutting positions, at a fixed radial distance from the longitudinal axis of the device, this distance being substantially greater than the radius of said cylindrical outer surface of the device, liquid passage means within said piston extending coaxially within said piston from the end of the piston nearest said threaded end to a location along said piston where it communicates with an annular channel at the outer side wall of the piston, said channel cooperating with a liquid passage means in said body having an opening at the inner wall of said bore to define valve means controlled by movement of said piston to allow escape of said pressurized liquid through the liquid passage means in said body to the area of said cutting elements when said piston is in its actuating position.

19. A drilling device according to claim 18 wherein said bearing surfaces are parts of said elements, each bearing surface being arranged at an acute angle relative to the cutting edge of the respective element.

20. A drilling device according to claim 18 wherein said other end of the cylindrical body includes additional cutting surfaces so located that each portion of a cutting area defined by rotation of the outer ends of the cutting edges of the tool is covered by part of said cutting surfaces or said cutting edges at some point of the tool rotation.

* * * * *